US009421763B2

(12) United States Patent
Sasaki

(10) Patent No.: US 9,421,763 B2
(45) Date of Patent: Aug. 23, 2016

(54) RECORDING APPARATUS

(71) Applicant: Seiko Epson Corporation, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/930,882

(22) Filed: Nov. 3, 2015

(65) Prior Publication Data

US 2016/0129708 A1 May 12, 2016

(30) Foreign Application Priority Data

Nov. 10, 2014 (JP) ..... 2014-227907

(51) Int. Cl.
*B41J 29/393* (2006.01)
*B41J 2/045* (2006.01)

(52) U.S. Cl.
CPC ..... *B41J 2/04556* (2013.01)

(58) Field of Classification Search
CPC ..... B41J 2/04556
See application file for complete search history.

(56) References Cited

U.S. PATENT DOCUMENTS

2007/0070097 A1 3/2007 Bich et al.
2014/0192109 A1* 7/2014 Endo ..... B41J 11/0095 347/16

FOREIGN PATENT DOCUMENTS

JP 05-097284 A 4/1993
JP 2006-168138 A 6/2006
JP 2007-516099 A 6/2007
JP 2009-096601 A 5/2009

* cited by examiner

*Primary Examiner* — Julian Huffman

(57) ABSTRACT

A recording apparatus includes: a transportation unit that transports a recording target medium; a recording unit that performs recording on the recording target medium transported by the transportation unit; a sonic distance sensor; a vibration sensor that detects vibrations of the distance sensor; and a movement unit that moves in an intersecting direction, which intersects with a transportation direction of the recording target medium. The recording apparatus having this structure can reduce problems caused by a rise in the recording target medium.

5 Claims, 5 Drawing Sheets

RECORDING APPARATUS

BACKGROUND

1. Technical Field

The present invention relates to a recording apparatus.

2. Related Art

A recording apparatus that transports a recording target medium and performs recording thereon is used in related art. In a recording apparatus that has such a structure, a problem arises due to a phenomenon of the rising of a recording target medium; for example, when a recording target medium is transported in a skewed state, the skew produces a rise in the recording target medium, resulting in the contact of the recording target medium with a recording unit. As an example of a technique for preventing such a problem, a recording apparatus that can optically calculate a distance between a recording unit and a recording target medium is disclosed in JP-A-2006-168138. An optical distance sensor is commonly used as a sensor that can measure a distance between a recording unit and a recording target medium in a recording apparatus. Besides an optical distance sensor, a sonic distance sensor disclosed in JP-A-5-097284 is known as a type of a distance sensor.

These days, various recording target media are used for recording in a recording apparatus. For example, when a transparent recording target medium, etc. is used, in some cases, sufficient detection precision cannot be obtained if an optical distance sensor is used. The inside of a recording apparatus is prone to vibrations. A sonic distance sensor is susceptible to vibrations. Therefore, detection precision is sometimes not sufficiently high if a sonic distance sensor is provided at a vibration-prone position. That is, in a recording apparatus of related art, it is sometimes difficult to measure a distance between a recording unit and a recording target medium with high precision. This makes it difficult to reduce problems caused by a rise in the recording target medium P.

SUMMARY

An advantage of some aspects of the invention is to reduce problems caused by a rise in a recording target medium.

A recording apparatus according to a first mode of the invention comprises: a transportation section that transports a recording target medium; a recording section that performs recording on the recording target medium transported by the transportation section; a sonic distance sensor; a vibration sensor that detects vibrations of the distance sensor; and a movement section that moves in an intersecting direction, which intersects with a transportation direction of the recording target medium.

In a recording apparatus according to a second mode of the invention, which is a preferred mode, in the first mode, the recording section is mounted on the movement section.

In a recording apparatus according to a third mode of the invention, which is a preferred mode, in the first or second mode, the vibration sensor is a contact-type vibration sensor that detects, in a state of being in contact with the distance sensor, the vibrations of the distance sensor.

In a recording apparatus according to a fourth mode of the invention, which is a preferred mode, in the first or second mode, the vibration sensor is a non-contact-type vibration sensor that detects, in a state of being not in contact with the distance sensor, the vibrations of the distance sensor.

In a recording apparatus according to a fifth mode of the invention, which is a preferred mode, in any of the first to fourth modes, the movement section includes an optical distance sensor.

By this means, it is possible to reduce problems caused by a rise in a recording target medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a recording apparatus according to exemplary embodiments of the present invention will now be explained in detail.

First Embodiment

Figure 1:
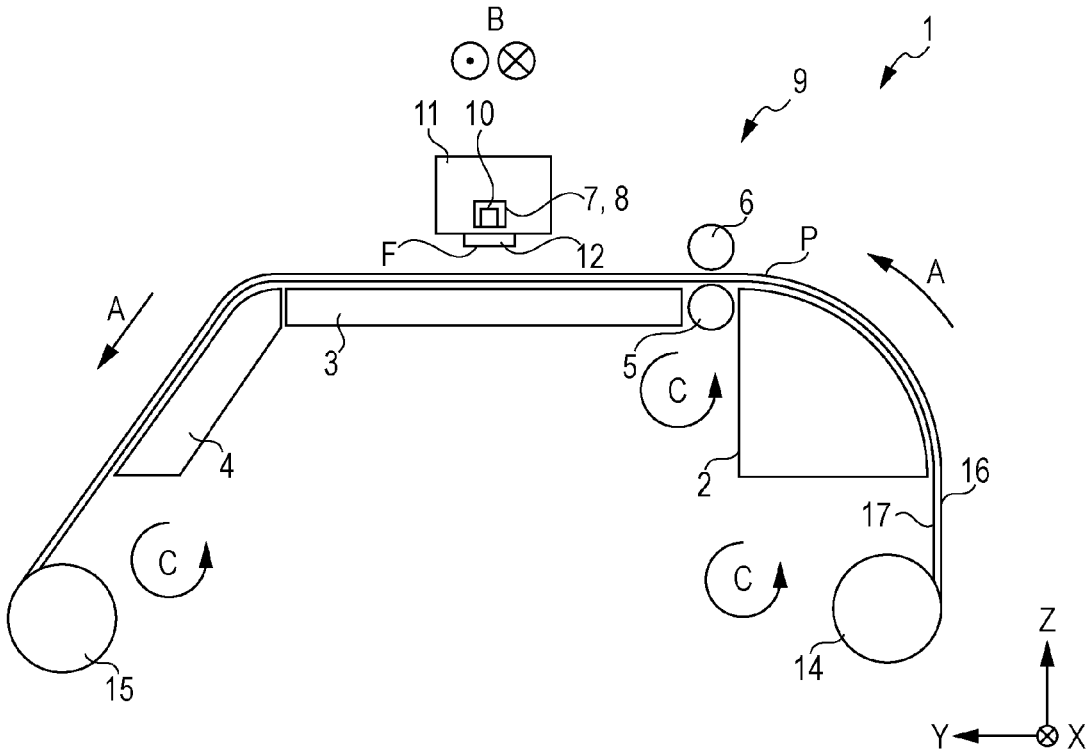
FIG. 1 is a schematic side view that illustrates a recording apparatus according to a first embodiment of the invention.
Figure 2:
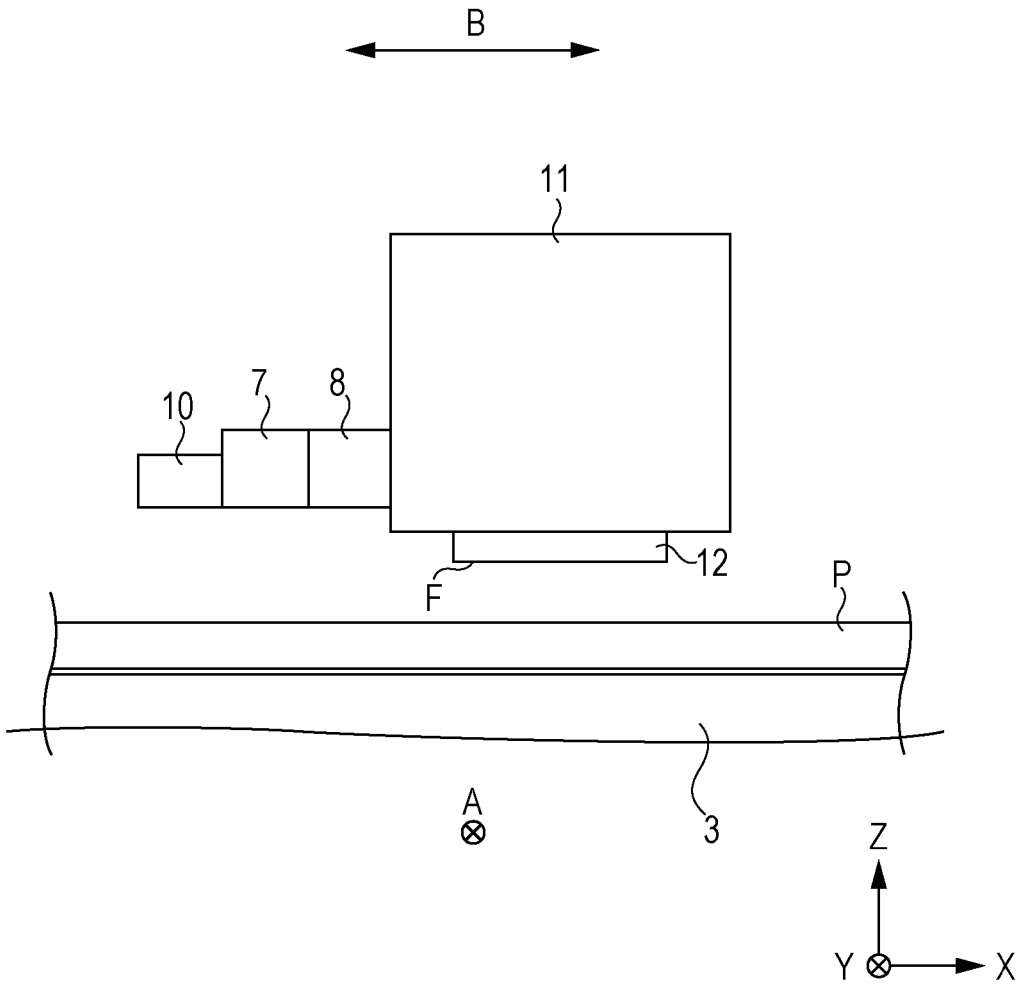
FIG. 2 is a schematic rear view that illustrates an essential part of a recording apparatus according to the first embodiment of the invention.

FIG. 1 is a schematic side view that illustrates a recording apparatus 1 according to a first embodiment of the invention. FIG. 2 is a schematic rear view that illustrates an essential part of the recording apparatus 1 according to the first embodiment of the invention. A carriage 11 including a sonic distance sensor 7 and a vibration sensor 10 as an essential part of the recording apparatus 1 is conceptually illustrated therein.

As illustrated in FIG. 1, the recording apparatus 1 of the present embodiment transports a recording target medium P in a transportation direction A from a feed-out portion 14, from which the recording target medium P is unreeled, to a reeling portion 15, which reels the recording target medium P, through platens 2, 3, and 4, which support the recording target medium P. That is, the transportation path of the recording target medium P leads from the feed-out portion 14 to the reeling portion 15 in the recording apparatus 1. The platens 2, 3, and 4 constitute a recording target medium supporting portion provided on the transportation path. The feed-out portion 14 rotates in a rotation direction C to unreel the recording target medium P. The reeling portion 15 rotates in the rotation direction C to reel the recording target medium P.

The recording apparatus 1 of the present embodiment is configured to be able to perform recording on roll-type recording target medium P. However, the configuration is not limited thereto. The recording apparatus 1 may be configured to be able to perform recording on sheet-type recording target medium P. When the recording apparatus 1 is configured to be able to perform recording on sheet-type recording target medium P, a so-called paper (feeder) tray or paper (feeder) cassette, etc. may be used as the feed-out portion 14, from which the recording target medium P is fed out. As an alternative receiver portion other than the reeling portion 15 for collecting the recording target medium P, for example, an ejection receiver, a so-called paper (ejector) tray or paper (ejector) cassette, etc. may be used.

In the recording apparatus 1 of the present embodiment, a driving roller 5 is provided between the platens 2 and 3, and a driven roller 6 is provided opposite (over) the driving roller 5. The driving roller 5 and the driven roller 6 constitute a transportation unit 9.

In the present embodiment, roll-type recording target medium P whose outer surface is a recording surface 16 is used. Therefore, when the recording target medium P is unreeled from the feed-out portion 14, the feed-out portion 14 rotates in the rotation direction C. If roll-type recording target medium P whose inner surface is the recording surface 16 is used, the recording target medium P can be unreeled from the feed-out portion 14 by rotation in the opposite direction. In like manner, in the present embodiment, the reeling portion 15 rotates in the rotation direction C because the reeling portion 15 reels the recording target medium P whose outer surface is the recording surface 16. The recording target medium P can be reeled onto the reeling portion 15 by rotation in the opposite direction if the inner surface is the recording surface 16.

The recording apparatus 1 of the present embodiment is equipped with a recording head 12 functioning as a recording unit. The recording head 12 and the platen 3 face each other. The recording apparatus 1 ejects ink from the ink ejection surface F of the recording head 12 while causing the carriage 11, on the bottom of which the recording head 12 is mounted, to reciprocate in an intersecting direction B, thereby forming an image as desired. Though the recording apparatus 1 of the present embodiment is equipped with the recording head 12, which performs recording while reciprocating, the recording apparatus 1 may be equipped with a so-called line head, in which plural nozzles for ink ejection are arranged in the intersecting direction B. The "line head" is a recording head that is used in a recording apparatus that forms an image by relative head-versus-medium movement wherein the area of nozzles formed in the direction B intersecting with the transportation direction A of the recording target medium P is formed in such a way as to cover the entirety of the recording target medium P in the intersecting direction B. The area of the nozzles formed in the intersecting direction B of the line head may be formed in such a way as not to cover the entirety of all of the recording target media P supported by the recording apparatus in the intersecting direction B.

A sonic distance sensor 7 is provided on the carriage 11. The sonic distance sensor 7 is susceptible to vibrations. Therefore, detection precision is sometimes not sufficiently high if the sonic distance sensor 7 is provided at a vibration-prone position. Since the carriage 11 moves in the traveling direction B, vibration sometimes occurs. To detect the vibrations of the distance sensor 7, a vibration sensor 10 is provided on the carriage 11 of the present embodiment. Therefore, under the control of a control unit 18 described later (refer to FIG. 3), it is possible to measure the distance between the recording head 12 and the recording target medium P with high precision by, for example, discarding and not using the detection results of the distance sensor 7 when vibrations are detected by the vibration sensor 10. By this means, it is possible to reduce problems caused by a rise in the recording target medium P.

In addition, an optical distance sensor 8 is provided on the carriage 11 of the present embodiment. That is, both the sonic distance sensor 7 and the optical distance sensor 8 are mounted on the carriage 11 of the present embodiment. The types of the recording target medium P whose rise can be better detected by means of the sonic distance sensor 7 are different from the types of the recording target medium P whose rise can be better detected by means of the optical distance sensor 8. To take advantage of the difference in forte therebetween, in the structure of the embodiment, the sonic distance sensor 7 and the optical distance sensor 8 can be selectively used depending on the type of the recording target medium P in use. Specifically, for example, if the recording target medium P is a transparent or embossed sheet, the sonic distance sensor 7 can be used. If the material of the recording target medium P is cloth, the optical distance sensor 8 can be used. If the material of the recording target medium P is paper or vinyl chloride, either of the sonic distance sensor 7 and the optical distance sensor 8 may be used for detecting a rise in the recording target medium P with high precision. For example, when the amount of a rise is computed, the greater value of the two may be used.

As illustrated in FIG. 2, the vibration sensor 10 is a so-called contact-type vibration sensor that detects the vibrations of the distance sensor 7 in a state in which it is in contact with the distance sensor 7. The vibration detection precision of a contact-type vibration sensor is high because it detects the vibrations of a distance sensor in a state in which it is in contact with the distance sensor. For this reason, the recording apparatus 1 of the present embodiment can detect the vibrations of the distance sensor 7 with high precision and thereby reduce, with high precision, an error caused in the measurement of the amount of a rise by the vibrations. Therefore, it is possible to reduce problems caused by a rise in the recording target medium P with high precision.

In the present embodiment, the optical distance sensor 8, the sonic distance sensor 7, and the vibration sensor 10 are arranged in this order in the intersecting direction B as illustrated in FIG. 2. However, the scope of the invention is not limited to the illustrated arrangement. For example, the sonic distance sensor 7, the optical distance sensor 8, and the vibration sensor 10 may be arranged in an order different from that of FIG. 2 in the intersecting direction B, or may be arranged in the transportation direction A. The vibration sensor 10 may be provided on the top of the sonic distance sensor 7.

In FIGS. 1 and 2, the directions X and Y are the horizontal directions orthogonal to each other, and the direction Z is the vertical direction. In the recording apparatus 1 of the present embodiment, the direction A of transportation of the recording target medium P over the platen 3 corresponds to the direction Y, and the intersecting direction B corresponds to the direction X.

Figure 3:
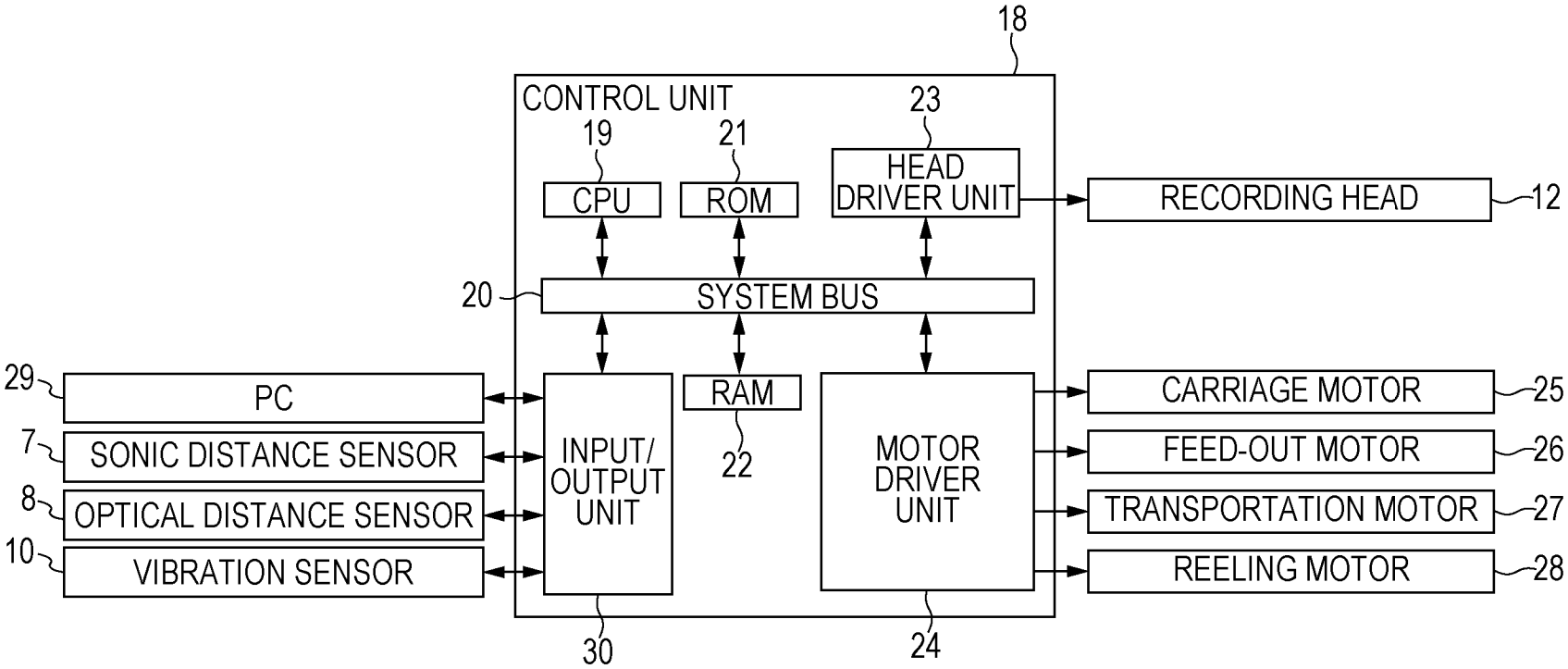
FIG. 3 is a block diagram that illustrates a recording apparatus according to the first embodiment of the invention.

Next, the electric configuration of the recording apparatus 1 of the present embodiment will now be explained. FIG. 3 is a block diagram of the recording apparatus 1 of the present embodiment. A CPU 19, which controls the entire operation of the recording apparatus 1, is provided in the control unit 18. The CPU 19 is connected via a system bus 20 to a ROM 21, in which various control programs and maintenance sequences that are to be run by the CPU 19 are stored, and a RAM 22, into which data can be stored temporarily.

In addition, the CPU 19 is connected via the system bus 20 to a head driver unit 23, which drives the recording head 12. Moreover, the CPU 19 is connected via the system bus 20 to a motor driver unit 24, which drives a carriage motor 25, a feed-out motor 26, a transportation motor 27, and a reeling motor 28. The carriage motor 25 causes the carriage 11 to move. The feed-out motor 26 is the driving source of the feed-out portion 14. The transportation motor 27 is the driving source of the driving roller 5. The reeling motor 28 is the driving source of the reeling portion 15. Furthermore, the CPU 19 is connected via the system bus 20 to an input/output unit 30. The input/output unit 30 is connected to the sonic distance sensor 7, the optical distance sensor 8, the vibration sensor 10, and a PC 29, which is an external apparatus that inputs recording data, etc. into the recording apparatus 1.

The control unit 18 of the present embodiment controls the entire operation of the recording apparatus 1. Examples of the control performed by the control unit 18 are: control of discarding and not using the detection results of the distance sensor 7 when vibrations are detected by the vibration sensor 10, control of selecting the distance sensor 7 or 8, and control of stopping the movement of the carriage 11 and stopping the transportation of the recording target medium P when a rise in the recording target medium P is detected by the distance sensor 7 or 8.

Second Embodiment

Figure 4:
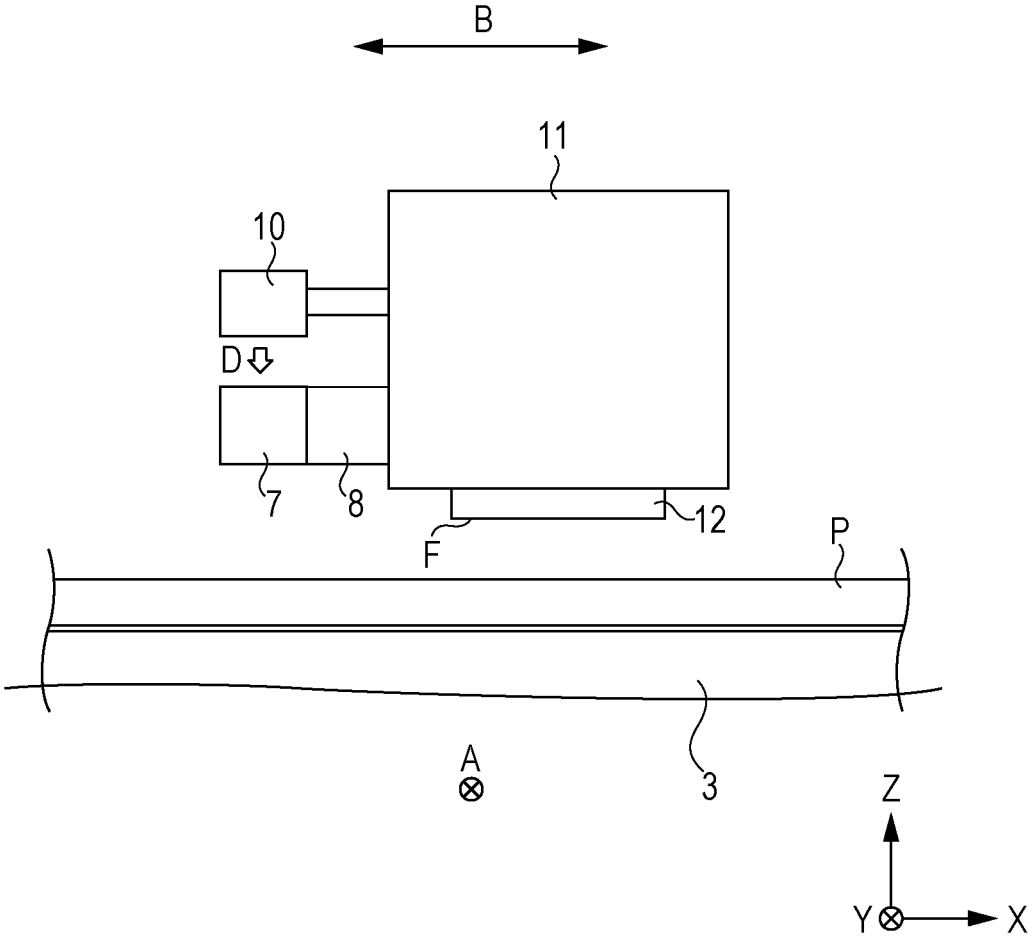
FIG. 4 is a schematic rear view that illustrates an essential part of a recording apparatus according to a second embodiment of the invention.

Next, with reference to the accompanying drawings, a recording apparatus according to a second embodiment of the present invention will now be explained in detail. FIG. 4 is a schematic rear view that illustrates an essential part of the recording apparatus 1 of the present embodiment. FIG. 4 corresponds to FIG. 2, which illustrates an essential part of the recording apparatus 1 of the first embodiment. The same reference numerals are assigned to the same components as those of the foregoing embodiment. A detailed explanation of them is not given here. The structure of the recording apparatus 1 of the present embodiment is the same as that of the recording apparatus 1 of the first embodiment except that the vibration sensor 10 provided on the carriage 11 is not a contact-type vibration sensor but a non-contact-type vibration sensor.

As illustrated in FIG. 4, the vibration sensor 10 of the present embodiment is a non-contact-type vibration sensor that detects the vibrations of the sonic distance sensor 7 in a state in which it is not in contact with the distance sensor 7. More specifically, the vibration sensor 10 of the present embodiment is provided on the carriage 11 over the top of the distance sensor 7 and is configured to be able to detect the vibrations of the distance sensor 7 by monitoring the distance sensor 7 in a direction D. Since the vibration sensor 10 is configured to be able to detect the vibrations of the distance sensor 7 in a non-contact state, the flexibility of the mounting position of the vibration sensor 10 is greater. Though the vibration sensor 10 of the present embodiment is provided on the carriage 11 over the top of the distance sensor 7, the mounting position of the vibration sensor 10 is not specifically limited, as long as it is provided on the carriage 11.

Third Embodiment

Figure 5:
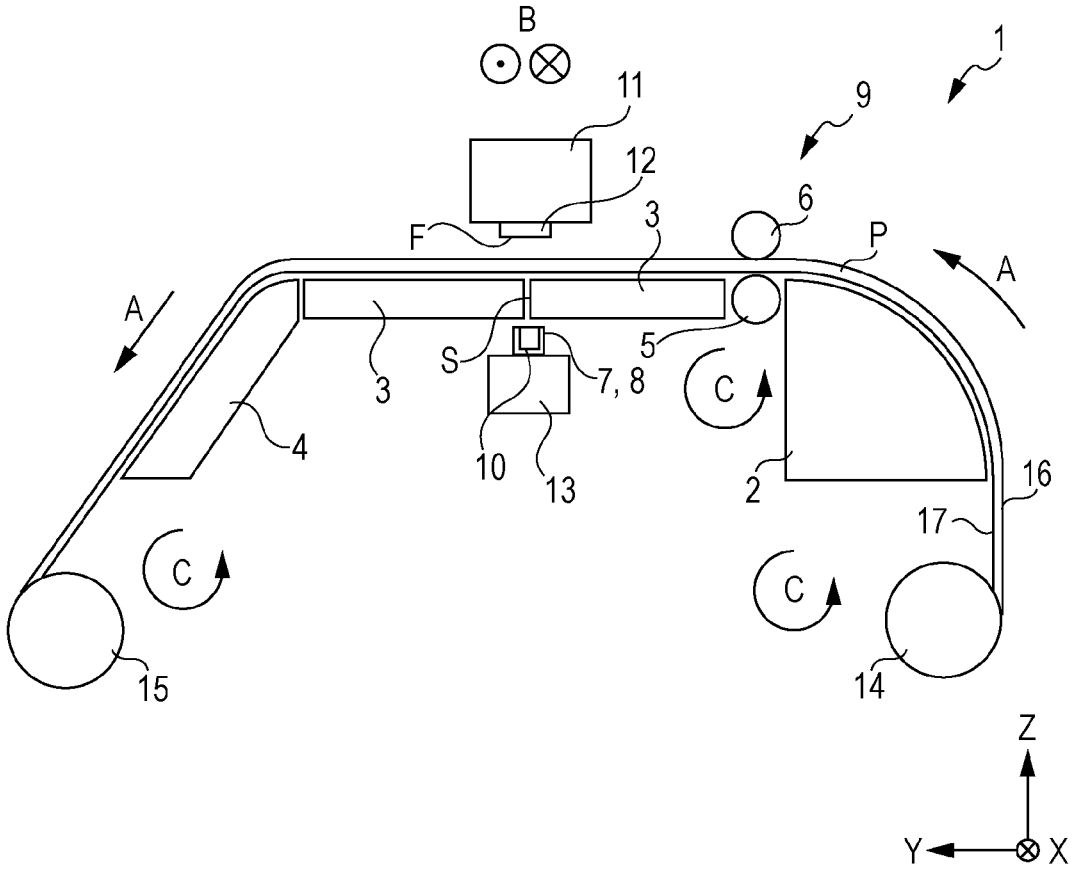
FIG. 5 is a schematic side view that illustrates a recording apparatus according to a third embodiment of the invention.

Next, with reference to the accompanying drawings, a recording apparatus according to a third embodiment of the present invention will now be explained in detail. FIG. 5 is a schematic side view that illustrates the recording apparatus 1 of the present embodiment. FIG. 5 corresponds to FIG. 1, which illustrates the recording apparatus 1 of the first embodiment. The same reference numerals are assigned to the same components as those of the foregoing embodiment. A detailed explanation of them is not given here. The structure of the recording apparatus 1 of the present embodiment is the same as that of the recording apparatus 1 of the first embodiment except that the distance sensors 7 and 8 and the vibration sensor 10 are not mounted on the carriage 11 and that a sensor carriage 13, on which the distance sensors 7 and 8 and the vibration sensor 10 are mounted, is provided separately from the carriage 11 as a movement unit that can move in the intersecting direction B.

As described earlier, in the recording apparatus 1 of the first embodiment, the distance sensors 7 and 8 and the vibration sensor 10 are mounted on the carriage 11, which includes the recording head 12. To put it another way, the carriage 11, on which the distance sensors 7 and 8 and the vibration sensor 10 are mounted, is provided with the recording head 12 functioning as a recording unit. Therefore, in the recording apparatus 1 of the first embodiment, it is not necessary to provide another movement unit on which the distance sensors 7 and 8 and the vibration sensor 10 are mounted in addition to the carriage 11, which includes the recording head 12. For this reason, the structure of the recording apparatus 1 of the first embodiment is simpler and lower in cost.

In contrast, in the recording apparatus 1 of the present embodiment, the distance sensors 7 and 8 and the vibration sensor 10 are not mounted on the carriage 11. Therefore, the sensor carriage 13, on which the distance sensors 7 and 8 and the vibration sensor 10 are mounted, is provided separately from the carriage 11 as a movement unit that can move in the intersecting direction B.

As with the case with the recording apparatus 1 of the first and second embodiments, the recording apparatus 1 of the present embodiment can perform recording by reciprocating the recording head 12 in the intersecting direction B. However, since the sensor carriage 13 is provided separately from the carriage 11, for example, it is not necessary to mount the recording head 12 on the carriage 11, and a line head can be used as the recording unit.

In the recording apparatus 1 of the present embodiment, a slit S extending in the intersecting direction B is formed in the platen 3. The distance sensor 7, 8 detects a rise in the recording target medium P through the slit S. However, the scope of the invention is not limited to such a slit-type structure.

The position of the sensor carriage 13 is not specifically limited. However, if the sensor carriage 13 is provided opposite the recording head 12 as in the present embodiment, it is possible to detect a rise in the recording target medium P from the reverse side, at which the reverse surface 17, which is the opposite of the recording surface 16, of the recording target medium P is located. Therefore, it is possible to eliminate the effect of ink droplets having landed onto the recording target medium P and detect a rise in the recording target medium P without a decrease in detection precision.

The scope of the invention is not limited to the foregoing embodiments. The invention may be modified, altered, changed, adapted, and/or improved within the scope of the recitation of appended claims. Needless to say, a recording apparatus subjected to such a modification, alteration, change, adaptation, and/or improvement is also within the scope of the invention. The following is a summary of the exemplary embodiments of the invention explained in detail above.

A recording apparatus 1 according to a first mode of the invention comprises: a transportation unit 9 that transports a recording target medium P; a recording unit 12 that performs recording on the recording target medium P transported by the transportation unit 9; a sonic distance sensor 7; a vibration sensor 10 that detects vibrations of the distance sensor 7; and a movement unit 11 that moves in an intersecting direction B, which intersects with a transportation direction A of the recording target medium P.

In this aspect, the movement unit 11, which moves in the direction B intersecting with the transportation direction A of the recording target medium P, includes a sonic distance sensor 7 and a vibration sensor 10. The vibration sensor 10 detects vibrations of the distance sensor 7. Therefore, it is possible to measure the distance between the recording head 12 and the recording target medium P with high precision by, for example, discarding and not using the detection results of the distance sensor 7 when vibrations are detected by the vibration sensor 10. By this means, it is possible to reduce problems caused by a rise in the recording target medium P.

In a recording apparatus 1 according to a second mode of the invention, which is a preferred mode, in the first mode, the recording unit 12 is mounted on the movement unit 11.

In this preferred mode, the recording unit 12 is mounted on the movement unit 11. That is, the distance sensor 7 and the vibration sensor 10 are provided on the movement unit 11, which includes the recording unit 12. Therefore, it is not necessary to provide another movement unit 11 on which the distance sensor 7 and the vibration sensor 10 are provided in addition to the movement unit 11, which includes the recording unit 12. This makes the structure of the recording apparatus 1 simpler and lower in cost.

In a recording apparatus 1 according to a third mode of the invention, which is a preferred mode, in the first or second mode, the vibration sensor 10 is a contact-type vibration sensor that detects, in a state of being in contact with the distance sensor 7, the vibrations of the distance sensor 7.

In this preferred mode, the vibration sensor 10 is a contact-type vibration sensor that detects the vibrations of the distance sensor 7 in a state in which it is in contact with the distance sensor 7. Since the contact-type vibration sensor 10 detects the vibrations of the distance sensor 7 in a state in which it is in contact with the distance sensor 7, its vibration detection precision is high. Therefore, it is possible to reduce, with high precision, problems caused by a rise in a recording target medium.

In a recording apparatus 1 according to a fourth mode of the invention, which is a preferred mode, in the first or second mode, the vibration sensor 10 is a non-contact-type vibration sensor that detects, in a state of being not in contact with the distance sensor 7, the vibrations of the distance sensor 7.

In this preferred mode, the vibration sensor 10 is a non-contact-type vibration sensor that detects the vibrations of the distance sensor 7 in a state in which it is not in contact with the distance sensor 7. Since the non-contact-type vibration sensor 10 can detect the vibrations of the distance sensor 7 in a non-contact state, the flexibility of the mounting position of the vibration sensor 10 is greater.

In a recording apparatus 1 according to a fifth mode of the invention, which is a preferred mode, in any of the first to fourth modes, the movement unit 11 includes an optical distance sensor 8.

In this preferred mode, the movement unit 11 includes an optical distance sensor 8. That is, both the sonic distance sensor 7 and the optical distance sensor 8 are mounted on the movement unit 11. The types of the recording target medium P whose rise can be better detected by means of the sonic distance sensor 7 are different from the types of the recording target medium P whose rise can be better detected by means of the optical distance sensor 8. The sonic distance sensor 7 and the optical distance sensor 8 can be selectively used depending on the type of the recording target medium P in use.

The entire disclosure of Japanese Patent Application No. 2014-227907, filed Nov. 10, 2014 is expressly incorporated by reference herein.

What is claimed is:

1. A recording apparatus, comprising:

a transportation section that transports a recording target medium;

a recording section that performs recording on the recording target medium transported by the transportation section;

a sonic distance sensor;

a vibration sensor that detects vibrations of the distance sensor; and a movement section that moves in an intersecting direction, which intersects with a transportation direction of the recording target medium.

2. The recording apparatus according to claim 1, wherein the recording section is mounted on the movement section.

3. The recording apparatus according to claim 1, wherein the vibration sensor is a contact-type vibration sensor that detects, in a state of being in contact with the distance sensor, the vibrations of the distance sensor.

4. The recording apparatus according to claim 1, wherein the vibration sensor is a non-contact-type vibration sensor that detects, in a state of being not in contact with the distance sensor, the vibrations of the distance sensor.

5. The recording apparatus according to claim 1, wherein the movement section includes an optical distance sensor.

* * * * *